US009541333B2

(12) United States Patent
Angermann

(10) Patent No.: US 9,541,333 B2
(45) Date of Patent: Jan. 10, 2017

(54) STACKED HEAT EXCHANGER

(75) Inventor: Hans-Heinrich Angermann, Stuttgart (DE)

(73) Assignee: MAHLE International GmbH, Stuttgart (DE)

( * ) Notice: Subject to any disclaimer, the term of this patent is extended or adjusted under 35 U.S.C. 154(b) by 388 days.

(21) Appl. No.: 13/459,965

(22) Filed: Apr. 30, 2012

(65) Prior Publication Data

US 2012/0273173 A1 Nov. 1, 2012

(30) Foreign Application Priority Data

Apr. 28, 2011 (DE) ..... 20 2011 005 693 U

(51) Int. Cl.

| | |
|---|---|
| ***F28D 9/00*** | (2006.01) |
| ***F28F 9/00*** | (2006.01) |
| ***F28F 21/08*** | (2006.01) |
| ***F28F 13/00*** | (2006.01) |
| ***F28F 19/00*** | (2006.01) |
| ***F28F 13/18*** | (2006.01) |

(52) U.S. Cl.

CPC ..... *F28D 9/0037* (2013.01); *F28F 9/001* (2013.01); *F28F 13/18* (2013.01); *F28F 19/00* (2013.01); *F28F 21/083* (2013.01); *F28F 21/084* (2013.01)

(58) Field of Classification Search

CPC ..... F28F 13/18; F28F 19/00; F28F 9/001
USPC ..... 165/134.1, 166
See application file for complete search history.

(56) References Cited

U.S. PATENT DOCUMENTS

| | | | | |
|---|---|---|---|---|
| 4,083,400 | A * | 4/1978 | Dziedzic et al. | 165/165 |
| 4,414,023 | A * | 11/1983 | Aggen et al. | 420/40 |
| 4,436,145 | A * | 3/1984 | Manfredo et al. | 165/67 |
| 4,517,441 | A * | 5/1985 | Kaljee et al. | 219/146.23 |
| 4,688,629 | A * | 8/1987 | Kohnken | 165/82 |
| 4,857,697 | A * | 8/1989 | Melville | 219/121.63 |
| 4,970,770 | A * | 11/1990 | Jansson et al. | 29/890.044 |
| 5,332,544 | A * | 7/1994 | Uematsu et al. | 420/40 |
| 6,334,483 | B1 * | 1/2002 | Berglund et al. | 165/134.1 |
| 8,286,695 | B2 * | 10/2012 | Greaney et al. | 165/134.1 |
| 2003/0005981 | A1 * | 1/2003 | Ogawa et al. | 148/428 |
| 2005/0058851 | A1 * | 3/2005 | Smith et al. | 428/685 |
| 2006/0239853 | A1 * | 10/2006 | Maehara et al. | 420/492 |
| 2007/0039722 | A1 * | 2/2007 | Angermann | 165/158 |
| 2007/0107889 | A1 * | 5/2007 | Zaffetti et al. | 165/166 |

(Continued)

FOREIGN PATENT DOCUMENTS

| | | | | |
|---|---|---|---|---|
| DE | 103 28 274 A1 | | 1/2004 | |
| DE | 2003128274 | * | 1/2004 | B23K 1/0012 |

(Continued)

OTHER PUBLICATIONS

Klueh, R. L., Shingledecker, J. P., Swindeman, R. W., & Hoelzer, D. T. (2005). "Oxide dispersion-strengthened steels: A comparison of some commercial and experimental alloys". Journal of Nuclear Materials, 341(2-3), 103-114).*

*Primary Examiner* — M. Alexandra Elve
*Assistant Examiner* — Joel Attey
(74) *Attorney, Agent, or Firm* — Muncy, Geissler, Olds & Lowe, P.C.

(57) ABSTRACT

A stacked heat exchanger, in particular ferritic welded heat exchanger for high temperature applications, is provided that has stack plates that are held between cover plates and/or an outer housing. Aluminum is added to the cover plates and/or the housing in production.

14 Claims, 2 Drawing Sheets

(56) References Cited

U.S. PATENT DOCUMENTS

| | | | | |
|---|---|---|---|---|
| 2008/0072425 | A1* | 3/2008 | Whittenberger et al. | 29/890.03 |
| 2008/0146467 | A1* | 6/2008 | Takayama | 508/105 |
| 2008/0202735 | A1* | 8/2008 | Geskes et al. | 165/166 |
| 2008/0210413 | A1* | 9/2008 | Hislop et al. | 165/166 |
| 2009/0173481 | A1* | 7/2009 | Mitsui et al. | 165/166 |
| 2009/0263680 | A1* | 10/2009 | Mata et al. | 429/13 |
| 2009/0317679 | A1* | 12/2009 | Stanislowski et al. | 429/26 |
| 2010/0051249 | A1* | 3/2010 | Taniguchi | F28F 3/086 165/166 |
| 2010/0239924 | A1* | 9/2010 | McElroy et al. | 429/423 |
| 2012/0138280 | A1 | 6/2012 | Angermann | |

FOREIGN PATENT DOCUMENTS

| | | | |
|---|---|---|---|
| DE | 10 2007 056 182 | A1 | 5/2008 |
| DE | 10 2010 029 287 | A1 | 1/2011 |
| EP | 2 110 635 | A1 | 10/2009 |
| WO | WO 03/033133 | A1 | 4/2003 |

* cited by examiner

STACKED HEAT EXCHANGER

This nonprovisional application claims priority under 35 U.S.C. §119(a) to German Patent Application No. DE 20 2011 005 693.7, which was filed in Germany on Apr. 28, 2011, and which is herein incorporated by reference.

BACKGROUND OF THE INVENTION

Field of the Invention

The invention relates to a stacked heat exchanger, in particular welded, ferritic heat exchanger for high temperature applications.

Description of the Background Art

A stacked heat exchanger is disclosed, for example, by the applicant in DE 10328274 A1. Here, suitably contoured metal sheets, alternating with solder foils if applicable, are stacked—framed by cover plates—in a fixture, suitably pre-pressed, and welded to boxes while the tension is maintained. These boxes have the dual function of maintaining the preloading as a lost soldering device and ensuring the delivery of material to the heat exchanger. If no solder foils are going to be used, solder can also be provided in a variety of ways, including externally, namely before the boxes are welded on. The thus pretreated stacked heat exchanger is then sealed by soldering.

In addition, a stacked heat exchanger is disclosed by the applicant in DE 10 2007 056 182 A1 in which the internal heat exchanger block is mechanically separated by a decoupling device from the housing, which is sealed with respect to the outside. The decoupling device can be, for example, a mineral fiber mat or a molded knit wire mesh, with filling or film covering if applicable. It is disadvantageous here that although thermomechanical decoupling is ensured, leakage occurs from one flow to the other flow via the decoupling device, impairing heat transfer performance.

DE 10 2009 022 984 A1 discloses a heat exchanger that has a housing, made, e.g., of a Ni alloy, that is high temperature resistant relative to a soft core of, for example, ferritic stainless steels containing Al. The core is highly ductile in order to accommodate stresses during heating. The base material contains enough aluminum to minimize corrosion phenomena such as oxidation or Cr evaporation. The high strength and hot strength of the box material ensure that the component remains sealed to the outside, so that hydrogen cannot escape under any circumstances.

It is a disadvantage of the stacked heat exchangers known from the prior art, especially DE 10 2009 022 984 A1, however, that in an application in conjunction with an APU (Auxiliary Power Unit) and the long operating times there of 15 to 20 thousand hours, enough aluminum diffuses out of the aluminum-containing ferritic base material into the cover plate and box material made of Ni alloys to drop below the critical content of aluminum in the aluminum-containing ferrites needed to be able to produce the protective $Al_2O_3$ layer. This results in what is called breakaway (catastrophic) oxidation with the development of leaks in the stacked heat exchanger.

SUMMARY OF THE INVENTION

It is therefore an object of the invention to provided an improved stacked heat exchanger.

According to an embodiment of the invention, aluminum is also added in production to the cover plates and/or the housing of the stacked heat exchanger. Here, "in production" means that the cover plates and/or the housing of the stacked heat exchanger already have a certain aluminum content prior to the first operational use.

A first embodiment makes provision for an alloy that contains aluminum to be provided in production for the cover plates and/or the housing. In other words, an alloy that already contains Al is selected for manufacturing the cover plates and/or the housing. The result of this, in particular, is a long-lasting—within the framework of the commercial vehicle APU (auxiliary power unit) application—and corrosion-resistant weld joint between the Ni alloy (housing material) and the aluminum-containing ferritic stainless steel.

Another embodiment makes provision for a nickel alloy with at least 1.8% by weight aluminum to be provided in production for the cover plates and/or the housing. An example of an alloy that could be used is the Nicrofer 6025 HHT alloy from the ThyssenKrupp company.

In order to further limit the outward diffusion of aluminum, the alloy of the cover plates and/or the housing can also have higher aluminum values. By way of example, the Haynes 214 nickel alloy is mentioned, which contains approximately 4.5% aluminum.

Another embodiment makes provision for an aluminized material with aluminum applied to or incorporated in a semifinished material, in particular by heat treatment, to be provided for the cover plates and/or the housing. Thus, the aluminum is not contained in the material as an alloy component from the very beginning here, but instead is applied to the semifinished material and, if applicable, also incorporated in it by means of a heat treatment, in a later process. Possible methods that can be used for applying aluminum are, for example, hot-dip aluminizing, or coating by chemical or electrochemical processes. For example, the aluminum can be applied to and/or incorporated in the base material by powder pack or gas phase aluminizing.

The aluminum content on and/or in the surface is chosen in accordance with the invention such that the aluminum content of the $Al_2O_3$ layer (boundary surface) does not drop below 1.8% by weight, even after a relatively long time (several thousand hours) at high temperature, for example 900° C., during which the aluminum content of the coated semifinished material evens out by diffusion as a function of the thickness of the semifinished material.

The use of a ferritic alloy that contains aluminum as box and/or cover plate material is possible and even preferred, wherein the strength thereof, in particular the hot strength, must be greater than that of the ferritic, aluminum-containing, Fe-based ribbed sheet material. Such a material provides advantages because the formation of strength-reducing NiAl phases (due to inward diffusion of Al in a Ni-containing box and/or cover plate material) at the ribbed sheet/box or ribbed sheet/cover plate boundary surface is prevented, since the ferritic materials normally do not contain any Ni. If the ferritic, aluminum-containing material should nevertheless contain nickel, then the content must be limited to <10% by weight, in particular <5% by weight. A possible material is, for example, an iron-chromium-aluminum alloy with (in percent by weight) 2.0% to 4.5% Al, 12% to 25% Cr, 1.0% to 4% W, 0.25% to 2.0% Nb, 0.05% to 1.2% Si, 0.001% to 0.70% Mn, 0.001% to 0.030% C, 0.0001% to 0.05% Mg, 0.0001% to 0.03% Ca, 0.001% to 0.030% P, max. 0.03% N, max. 0.01% S, the remainder iron and the usual smelting-related impurities. The increased hot strength parameters are achieved through Laves phases, solid-solution hardening, and finely distributed carbides.

Another possibility is an aluminum-containing, ferritic ODS (oxide dispersion strengthened) Fe-based alloy, such as, e.g., the PM 2000 alloy from the Plansee company.

Another variation is to use one of the aforementioned FeCrAl alloys for the boxes and to use a high-strength aluminum-containing Ni alloy as cover plate material. The advantage here is that no NiAl precipitates can form in the thermomechanically especially stressed region between the ribbed sheet metal block and welded-on boxes, while a high-strength alloy is used for the cover plate, which is subjected to high stresses.

In an advantageous manner, the stacked heat exchanger can be designed for operation with and/or for an "auxiliary power" application for high-temperature fuel cells, in particular in mobile vehicles, as shown in FIG. 2.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
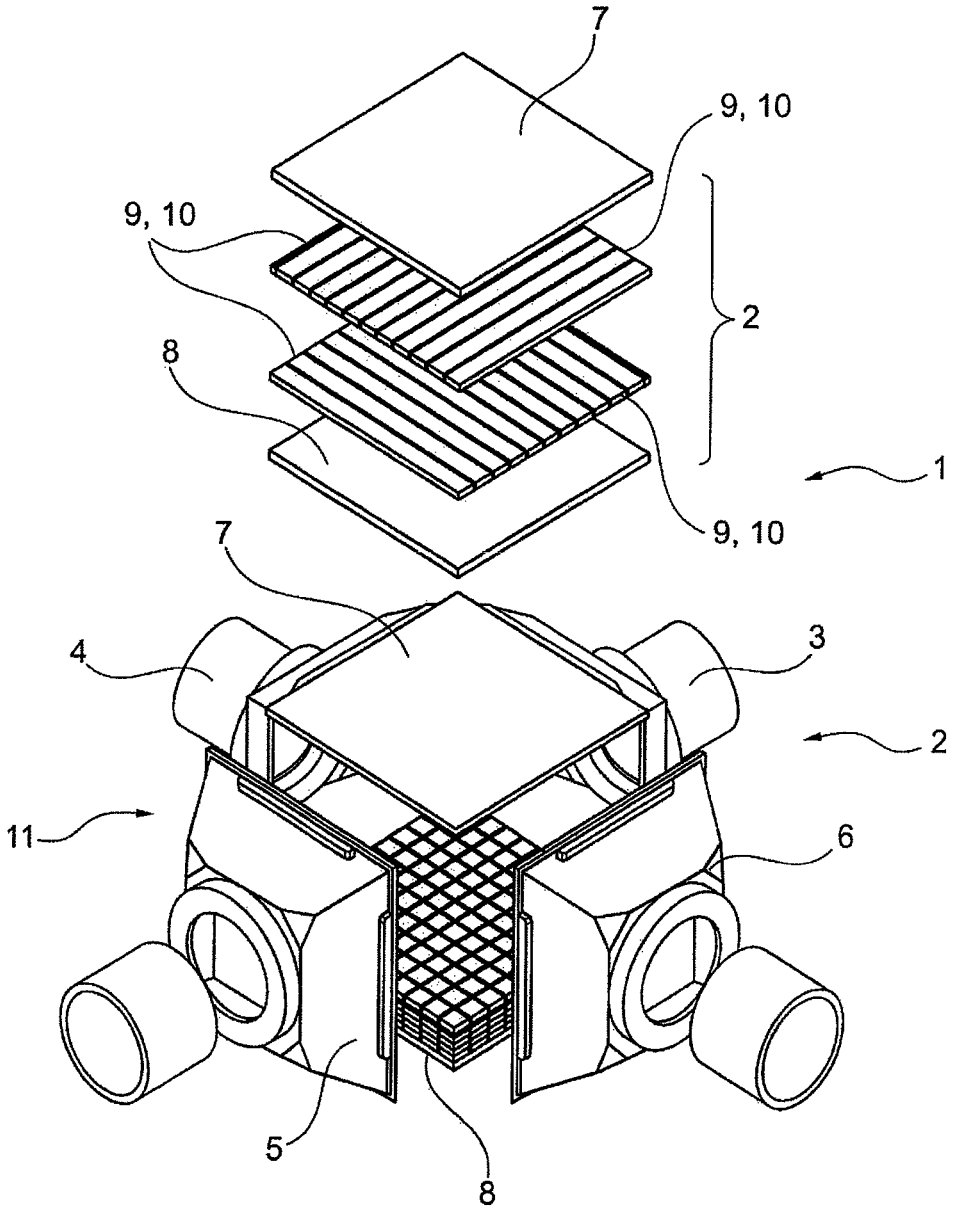
FIG. 1 illustrates a stacked heat exchanger according to an embodiment of the present invention.
Figure 2:
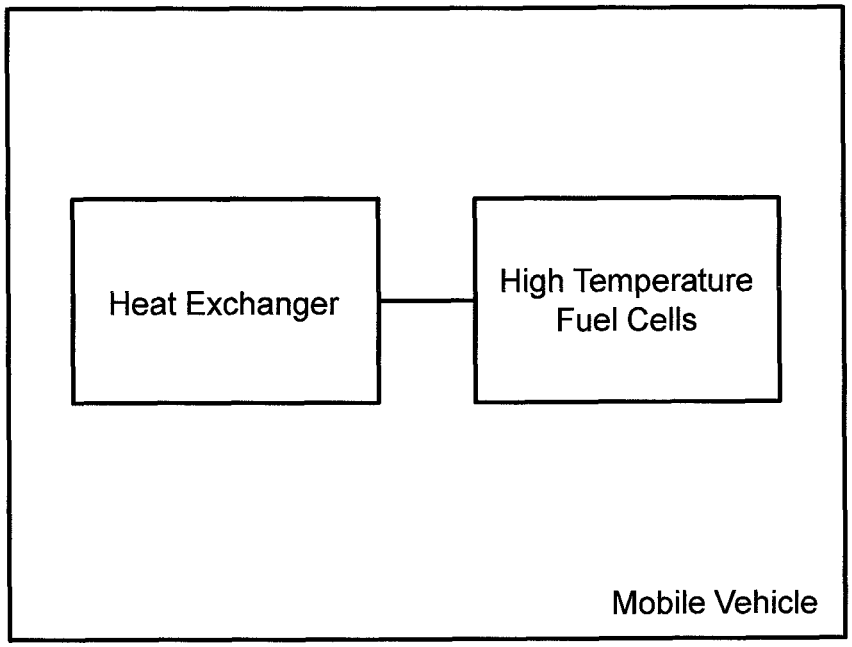
FIG. 2 is a block diagram illustrating a stacked heat exchanger according to an embodiment of the present invention with a high temperature fuel sells in a mobile vehicle.

FIG. 1 shows a stacked heat exchanger 1 with its individual components in an exploded view. The stacked heat exchanger 1 consists, on the one hand, of an approximately cubic or cuboid layered block 2, which is bounded by four side faces and two cover faces. Header boxes 3, 4, 5, 6, which serve to supply and remove a first and a second heat exchange medium, are placed on the four side faces. The cover faces are sealed by cover plates 7, 8. The layered block 2 is shown in an exploded view above the stacked heat exchanger 1 as a stack consisting of contoured stack plates 9, 10 and the two cover plates 7, 8. Only two stack plates 9, 10 with differently oriented contouring (webs and channels) are shown in the drawing—in actuality, the stack or layered block 2 naturally has a number of stack plates. For example, the layered block 2 can be completed and restrained in a fixture that is not shown. The stack is fixed in place thereafter.

In this design, the cover plates 7, 8, or the housing 11 composed of the individual elements, of the stacked heat exchanger 1 have a certain aluminum content that is already present before the first operational use.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A stacked heat exchanger comprising:

an outer housing including four header boxes each forming a respective side of the outer housing, each of the four header boxes having upper and lower sides and two lateral sides between the upper and lower sides, and;

two cover plates sealing upper and lower openings of the outer housing and each having a rectangular shape; and stack plates that are held between the cover plates, wherein the cover plates contain aluminum, and wherein the stack plates are stacked directly with each other without any solder or brazing therebetween, wherein the two lateral sides of each of the four header boxes are directly welded to one of the two lateral sides of an adjacent one of the four header boxes, wherein one of the two cover plates is directly welded to the upper side of a corresponding one of the four header boxes, wherein another one of the two cover plates is directly welded to the lower side of a corresponding one of the four header boxes, wherein an aluminum-containing Ni alloy is used for the cover plates, wherein the outer housing contains aluminum, and wherein the stacked heat exchanger is a ferritic welded heat exchanger for high temperature applications.

2. The stacked heat exchanger according to claim 1, wherein the aluminum contained in the cover plates is provided in an alloy.

3. The stacked heat exchanger according to claim 1, wherein the cover plates further contains a ferritic, aluminum-containing, Fe-based alloy, a strength of which is greater than that of the material of the stack plates.

4. The stacked heat exchanger according to claim 3, wherein the alloy comprises (in percent by weight) 2.0% to 4.5% Al, 12% to 25% Cr, 1.0% to 4% W, 0.25% to 2.0% Nb, 0.05% to 1.2% Si, 0.001% to 0.70% Mn, 0.001% to 0.030% C, 0.0001% to 0.05% Mg, 0.0001% to 0.03% Ca, 0.001% to 0.030% P, max. 0.03% N, max. 0.01% S, the remainder iron and usual smelting-related impurities.

5. The stacked heat exchanger according to claim 3, wherein the alloy is an oxide dispersion strengthened (ODS) alloy.

6. The stacked heat exchanger according to claim 1, wherein the cover plates contain a nickel alloy with at least 1.8% by weight aluminum.

7. The stacked heat exchanger according to claim 1, wherein the cover plates contain a nickel alloy with 4.5% by weight aluminum.

8. The stacked heat exchanger according to claim 1, wherein an aluminized material with aluminum applied to or incorporated in a semifinished material by heat treatment is provided for the cover plates.

9. A mobile vehicle, comprising:

a high temperature fuel cell; and the stacked heat exchanger according to claim 1 that is configured to collect and remove heat generated from the high temperature fuel cells.

10. The stacked heat exchanger according to claim 1, wherein the aluminum comprises an aluminum alloy.

11. The stacked heat exchanger according to claim 1, wherein the housing contains a ferritic, aluminum-containing, Fe-based alloy, a strength of the housing being greater than that of the material of the stack plates.

12. The stacked heat exchanger according to claim 10, wherein a FeCrAl alloy is used for the housing.

13. The stacked heat exchanger according to claim 1, wherein the aluminum is applied to the cover plates by hot-dip aluminizing, or coating by chemical or electro-chemical processes.

14. The stacked heat exchanger according to claim 1, wherein the aluminum is applied to or incorporated into a base material of the cover plates by powder pack or gas phase aluminizing.

* * * * *